US006644791B1

(12) United States Patent
Andrews

(10) Patent No.: US 6,644,791 B1
(45) Date of Patent: Nov. 11, 2003

(54) INK JET PRINTHEAD HAVING EFFICIENT HEAT DISSIPATION AND REMOVAL OF AIR

(75) Inventor: John R. Andrews, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/226,605

(22) Filed: Aug. 23, 2002

(51) Int. Cl.[7] ..... B41J 2/05; B41J 29/377; B41J 2/19

(52) U.S. Cl. ..... 347/65; 347/18; 347/92

(58) Field of Search ..... 347/63, 65, 20, 347/67, 18, 17, 92, 84–87, 56, 61

(56) References Cited

U.S. PATENT DOCUMENTS

| | | | | |
|---|---|---|---|---|
| 4,878,070 A | | 10/1989 | Watrobski | 347/58 |
| 5,017,941 A | | 5/1991 | Drake | 347/67 |
| 5,216,446 A | | 6/1993 | Satoi et al. | 347/58 |
| 5,459,498 A | | 10/1995 | Seccombe et al. | 347/18 |
| 5,657,061 A | | 8/1997 | Seccombe et al. | 347/18 |
| 5,739,830 A | | 4/1998 | John et al. | 347/49 |
| 5,815,185 A | | 9/1998 | Pietrzyk | 347/92 |
| 5,850,234 A | | 12/1998 | Kneezel et al. | 347/18 |
| 5,975,681 A | | 11/1999 | Ogasawara et al. | 347/47 |
| 6,116,712 A | | 9/2000 | Laharty et al. | 347/14 |
| 6,120,139 A | * | 9/2000 | Childers et al. | 347/92 |
| 6,164,752 A | | 12/2000 | Schaefer et al. | 347/30 |
| 6,260,963 B1 | | 7/2001 | Reistad et al. | 347/94 |

* cited by examiner

*Primary Examiner*—Juanita Stephens
(74) *Attorney, Agent, or Firm*—Fay, Sharpe, Fagan, Minnich & McKee, LLP

(57) ABSTRACT

A printhead for use in an ink jet printing device includes a nozzle plate which defines a plurality of droplet-emitting nozzles and a printhead housing bonded to the nozzle plate. A heater substrate is attached and oriented substantially perpendicular to the nozzle plate. An intermediate layer, along with a channel cap plate are attached to the heater substrate and define a plurality of ink channels in fluid communication with the nozzles. The printhead housing includes an internal wall, which defines an ink flow path around the heater substrate such that heat is transferred progressively and conductively to the flowing ink, thereby removing heat from the heater substrate and cooling the entire printhead. The printhead housing includes an air bubble accumulation chamber adjacent the top portion of the printhead housing to capture air bubble emitted due to the heating of the ink.

18 Claims, 10 Drawing Sheets

INK JET PRINTHEAD HAVING EFFICIENT HEAT DISSIPATION AND REMOVAL OF AIR

BACKGROUND OF THE INVENTION

The present invention relates to ink jet printers. It finds particular application in conjunction with a thermal ink jet printhead, and will be described with particular reference thereto. It is to be appreciated, however, that the invention finds further application in conjunction with other ink jet technologies, such as hot melt or phase change piezo ink jet, as well as microfluid transport devices used in biological, chemical, and pharmaceutical applications.

Thermal ink jet printing is generally a drop-on-demand type of ink jet printing, which uses thermal energy to produce a vapor bubble in an ink-filled channel that expels a droplet. A thermal energy generator, typically a resistor, is located in each of the channels at a predetermined distance from the nozzles. The resistors are individually addressed with a current pulse to momentarily vaporize the ink and form a bubble. As the bubble grows, the ink bulges from the nozzle, but it is contained by the surface tension of the ink as a meniscus. As the bubble begins to collapse, the ink still in the channel between the nozzle and bubble begins to move towards the collapsing bubble, causing a volumetric contraction of the ink at the nozzle. This results in the separation of the bulging ink as an ink droplet. The acceleration of the ink out of the nozzle while the bubble is growing provides momentum and velocity to the droplet in a substantially straight-line direction towards a recording medium, such as paper.

High-performance, high-speed thermal ink jet printheads generate large quantities of heat, especially during extended high-density printing, such as when the printhead completely covers a page with ink. The ink droplet ejecting performance of thermal ink jet printheads is temperature dependent, and as such, print quality is adversely affected as the device heats up. Much of the heat created in thermal ink jet printheads during operation is waste heat that, if not properly dealt with, leads to print quality failure modes. In fact, at least two failure modes can be encountered as the result of undissipated waste heat. One of these failure modes is analogous to vapor lock in automobile engines. More particularly, in a thermal ink jet printhead stable bubbles of air and ink block the flow of ink into the ink channels and cause print defects related to lack of ink flow to the drop ejectors. A second failure mode occurs when the heater substrate, drop ejectors and ink adjacent thereto achieve too high of a steady state temperature. This results in premature boiling, which prevents the well-timed explosive boiling that ejects stable and appropriately sized ink droplets. As a result of the self-heating of the printhead, the volume of ink ejected in each droplet becomes greater due to the higher energy content of the ink, as well as the lower viscosity of the ink. The increased spot size resulting from the larger ink droplets lead to non-uniformity in a variety of print characteristics, such as optical density, color hue and saturation, and text character width.

Various devices and methods for reducing overheating of the heater substrate and overall printhead have been employed. Many of the prior art devices incorporate a heat sink of sufficient thermal mass and low enough thermal resistance that the device temperature does not rise excessively. For example, FIG. 1 shows a prior art printhead 10 where a first, lower silicon heater substrate 12 is bonded to a second, upper silicon channel substrate 14. The channel substrate 14 includes parallel grooves 11 formed in the bottom surface, which extend in one direction. When the channel substrate 14 is bonded to the heater substrate 12, channels 20 and nozzles 33 are formed at front face 22. The thermal ink jet die module (composed of heater substrate 12 bonded to channel substrate 14) is bonded directly to a heat sink substrate 13, and adjacent to a daughter board (not shown).

Typically, these heat sinks, such as the one shown in FIG. 1, are massive and problematic for long, high-area coverage print jobs. Often times, special measures are required to remove heat from the heat sink, which gradually accumulates heat and, accordingly, rises in temperature. These special measures, which include water and/or air cooling of the heat sink, add expense and take up accessible design space.

The present invention contemplates a new and improved ink jet printhead, which overcomes the above-referenced problems and others.

BRIEF DESCRIPTION OF THE INVENTION

In accordance with one aspect of the present invention, a device for selectively applying droplets of at least one fluid to an associated medium includes a nozzle plate, which defines a plurality of fluid-emitting nozzles, and a heater substrate disposed adjacent and substantially perpendicular to the nozzle plate. The heater substrate has a rear surface, a front surface, a top surface, and a bottom surface, where the rear and front surfaces are substantially larger than the top and bottom surfaces. A fluid housing is attached to the nozzle plate. The fluid housing includes a fluid inlet for connecting to an associated fluid tank and a first internal wall, which defines a fluid flow path such that fluid flows from the fluid inlet substantially around all of the rear, top, and front surfaces of the heater substrate. An intermediate layer is disposed adjacent a portion of the front surface of heater substrate. The intermediate layer defines a plurality of fluid flow channels in fluid communication with the plurality of nozzles. A channel cap plate, which is disposed adjacent the intermediate layer, caps the plurality of fluid flow channels.

In accordance with another aspect of the present invention, a printhead for use with an ink jet printer includes a nozzle plate, which defines a plurality of ink-emitting nozzles, is disposed substantially parallel to an associated print medium. A heater substrate, which is disposed adjacent and substantially perpendicular to the nozzle plate, includes a plurality of heating elements. A printhead housing, which is attached to the nozzle plate, substantially surrounds the heater substrate. The printhead housing includes a first internal wall, which defines an ink flow path around the heater substrate. An ink flow channel defining layer, which is disposed adjacent a portion of the heater substrate, defines a plurality of ink flow channels in fluid communication with the plurality of nozzles.

Advantages and benefits of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE INVENTION

Figure 1:
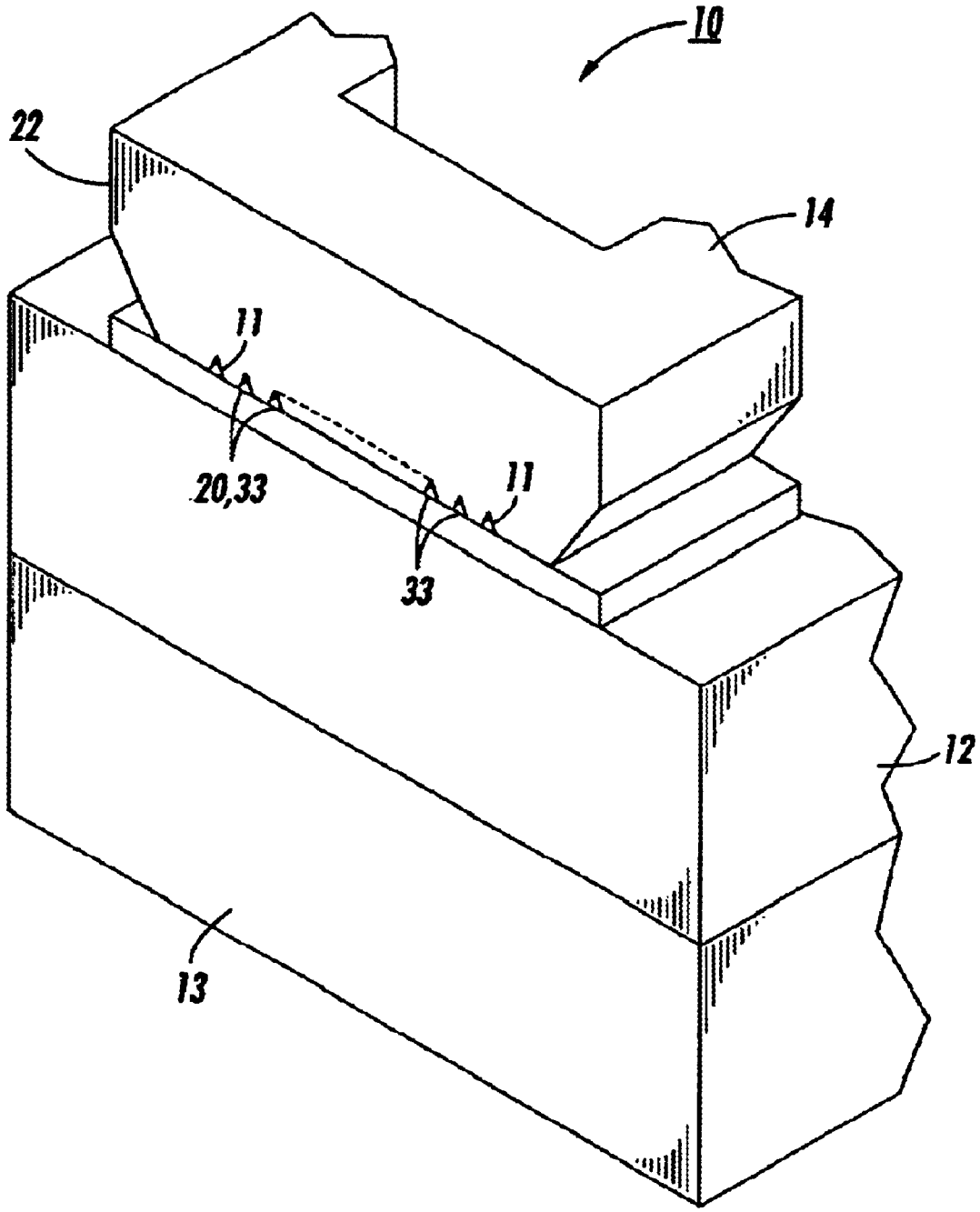
FIG. 1 PRIOR ART
FIG. 1 is an enlarged partial perspective view of a prior art printhead which includes a heat sink.
Figure 2:
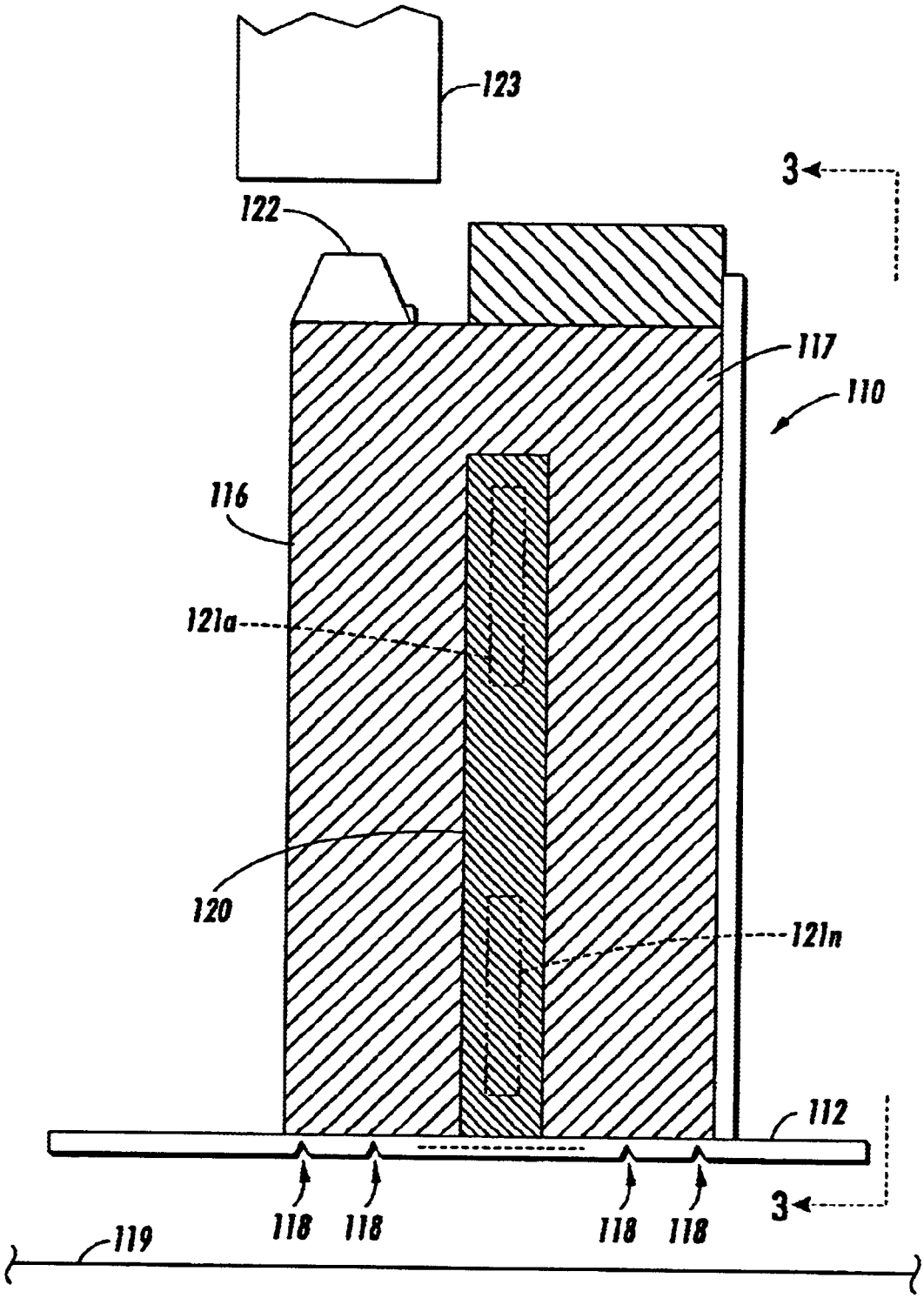
FIG. 2 is an end view of a printhead in accordance with the present invention.

Referring now to the drawings wherein the showings are made for purposes of illustrating preferred embodiments of the invention only and not for limiting the same, FIG. 2 shows an external end view of a microfluid transport and ejection device, such as a thermal ink jet printhead 110, in accordance with the present invention. The printhead 110 includes a nozzle plate 112 and an ink manifold or fluid printhead housing 116 attached or otherwise secured to the nozzle plate 112. As is described more fully below, the nozzle plate seals the printhead housing, forming an ink cavity 117 therein. Preferably, the nozzle plate 112 is comprised of a thin layer of a material, such as a polymer film. However, other suitable materials maybe employed. The nozzle plate 112 includes a plurality of fluid or ink-emitting nozzles 118, which are formed by a suitable process, such as punching, laser ablation, or chemical etching. In one embodiment, the printhead housing 116 is adhesively secured to the nozzle plate 112. Alternately, the printhead housing 116 is mechanically secured to the nozzle plate 112. As shown in FIG. 2, the nozzle plate 112 extends beyond the edges of the printhead housing 116, which in one embodiment, enables the sealing of the entire printhead housing 116 within a fluid cartridge, such as an ink cartridge.

While the present invention is being described in conjunction with a thermal ink jet printhead, it is to be appreciated that the present invention is applicable to a variety of microfluid transport and microfluid marking devices, which eject or otherwise deposit fluid droplets onto a medium 119 such as a print medium. Such devices include, but are not limited to, phase change or hot melt piezo ink jet printheads and microfluid transport and metering devices for use in pharmaceutical delivery, analytical chemistry, microchemical reactors and synthesis, genetic engineering and the like.

The printhead includes a heater substrate or die 120 disposed within the printhead housing 116, which contains a plurality of heating elements/ink heaters 121*a*, 121*n*, such as local resistive heaters, and drive logic associated therewith. As shown, the heater substrate 120 is disposed substantially perpendicular to the nozzle plate 112. As is described more fully below, this orientation exposes a larger percentage of the heater substrate surface to a fluid, such as ink, which travels through the printhead housing, thereby facilitating enhanced heat transfer from the heater substrate to the fluid. Preferably, a portion of the heater substrate 120 extends outside of the printhead housing 116. In this embodiment, the printhead housing 116 is sealed around the outwardly extending portion of the heater substrate 120, as shown. The printhead housing 116 includes an ink inlet 122, which connects to an associated fluid tank 123, such as an ink tank or cartridge.

Figure 3:
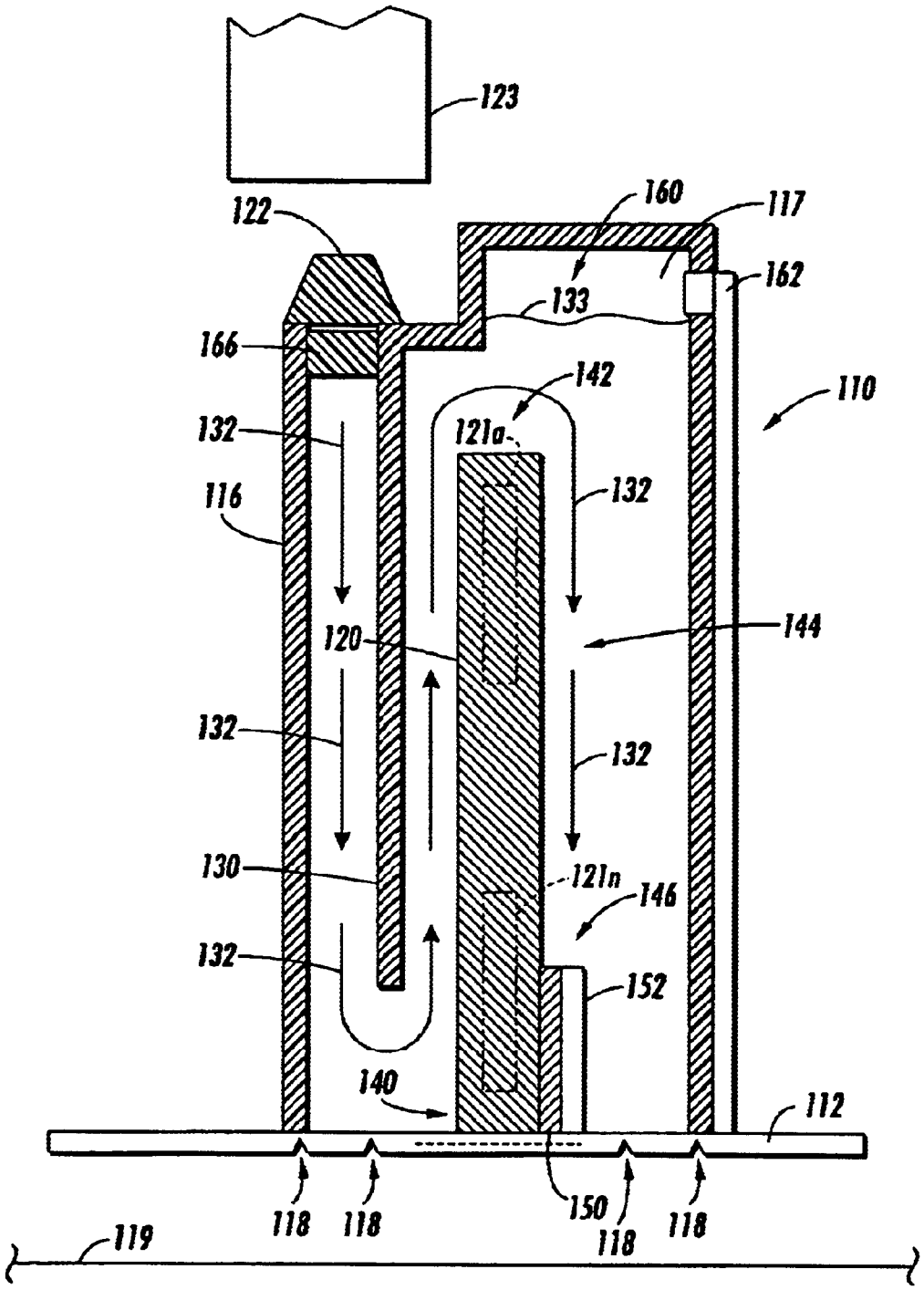
FIG. 3 is a cross-sectional view of the printhead of FIG. 2 as viewed along line 3—3.

With reference to FIG. 3 and continued reference to FIG. 2, the printhead housing 116 includes a first internal wall 130, which defines a fluid/ink flow path 132 of fluid/ink 133 around the heater substrate 120. Because of the substantially perpendicular orientation of the heater substrate 120 relative to the nozzle plate 112, the ink is exposed to and in thermal communication with a majority of the surface area of the heater substrate. As such, the heater substrate, on which the individual ink heaters 121*a*, 121*n* reside, serves as a cooling fin for conducting heat away from the heaters and spreading it out for heating the ink. More particularly, the internal wall 130 or other appropriate ink routing structure routes relatively cool ink from the ink inlet 122 to a bottom, rear surface 140 of the heater substrate 120 along ink flow path 132. As the ink flows along the heater substrate 120 from the bottom, rear surface 140 to a top surface 142, the ink is progressively and consistently heated by conductive heat transfer from the heater substrate to the ink. Conversely, as heat is transferred to the ink, the heater substrate is cooled, thereby providing enhanced printing operation. As shown, the ink continues to flow along ink flow path 132 from the top surface along a front surface 144 of the heater substrate. Ultimately, the ink is routed to a bottom, front area 146 of the heater substrate.

Figure 4:
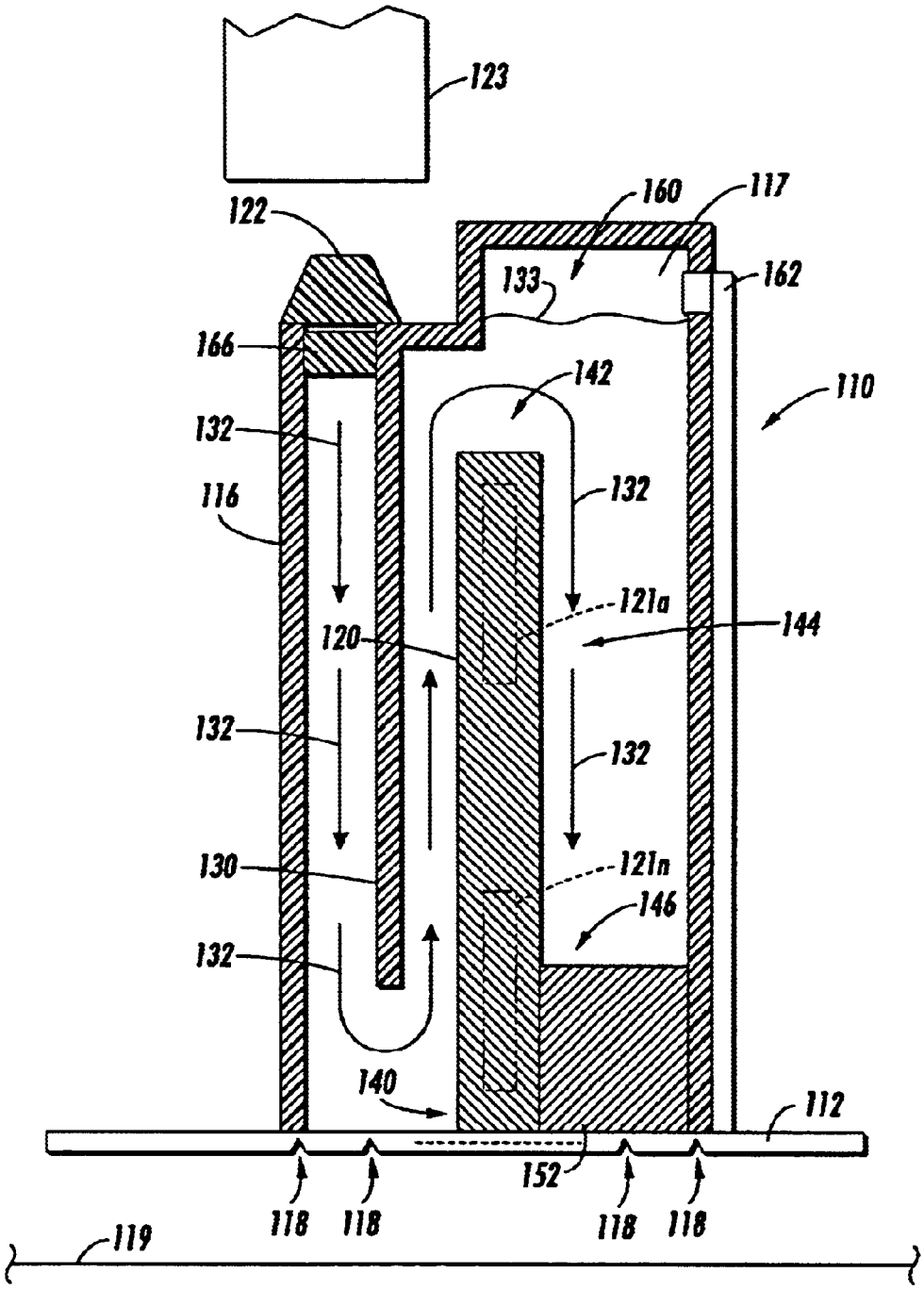
FIG. 4 is a cross-sectional view of the printhead of FIG. 2 as viewed along line 3—3 in accordance with another embodiment of the present invention.

As the ink reaches the bottom, front area 146 of the heater substrate, it flows into a plurality of fluid flow channels, which are in fluid communication with the plurality of nozzles defined within the nozzle plate 112. In one embodiment, illustrated in FIG. 3, the fluid flow channels are defined in an intermediate layer 150. The intermediate layer 150 may be comprised of a plurality of suitable materials, including RISTON®, VACRELO®, polyimide, SU-8, and the like. In one preferred embodiment, the intermediate layer is comprised of one or more thermally conductive layers, such as tantalum or the like, thereby providing increased efficacy in transferring heat away from the heaters disposed on the heater substrate to the ink flowing around the heater substrate. The embodiment illustrated in FIG. 3 includes a thin channel cap plate 152 disposed above the intermediate layer 150. The channel cap plate 152 forms the top of the fluid flow channels defined within the intermediate layer. Alternatively, as illustrated in FIG. 4, the channel cap plate 152 is a thick cap plate, which completely defines and encloses a plurality of fluid flow channels. In one embodiment, the channel cap plate 152 is comprised of ODE etched silicon. Alternatively, the channel cap plate is comprised of a molded plastic part, containing a plurality of channels therein.

Preferably, the channel cap plate 152 includes a generally open structure at the rear of the fluid flow channels, adjacent the bottom, front area 146 of the heater substrate 120. When the printhead 110 is disposed in the preferred orientation, shown in FIGS. 3 and 4, that is, an orientation with the nozzle plate 112 disposed substantially parallel to an associated printing medium with the nozzles directed downward, the open region at the rear of the fluid flow channels allows air to escape from the region closest to the heater substrate 120. In other words, as ink is heated by the heater substrate, the solubility of air within the ink decreases, and air diffuses out of the ink in the form of bubbles. The open region at the rear of the fluid flow channels allows these air bubbles to escape upwards without impeding the flow path 132 and adversely affecting print performance. The printhead housing 116 includes an air trap or bubble accumulation chamber 160 at or near the top of the printhead housing 116. The printhead further includes a means for removing accumulated air 162 from the air trap 160. The air removal means 162 is effective for removing air via a periodic priming operation, either at the time of changing the ink tank or as a routine maintenance operation. In one embodiment, the printhead housing 116 includes an ink filter 166, which prevents particles and other contaminants from entering and eventually clogging the printhead. Preferably, the ink filter 166 is disposed adjacent the ink inlet 122, as shown in FIGS. 3 and 4.

Figure 5:
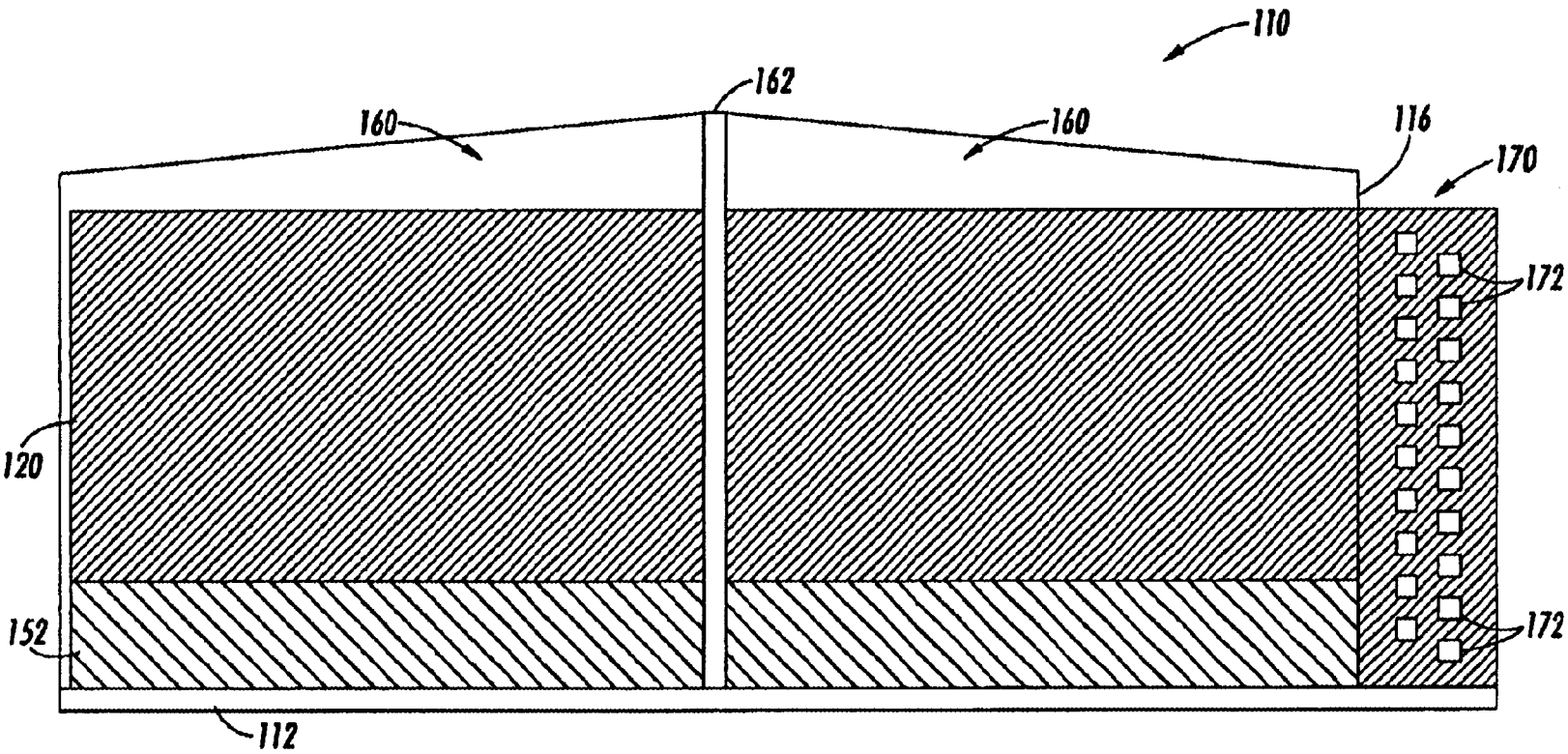
FIG. 5 is a partial side view of the printhead in accordance with the present invention.

With reference now to FIG. 5 and continued references to FIGS. 2–4, where like reference numerals refer to like elements, in one embodiment, a portion 170 of the heater substrate 120 extends outside of the printhead housing 116. The portion 170 of the heater substrate 120 protruding from the printhead housing 116 includes a plurality of electrical contacts or bond pads 172, which enable electrical contact to be made from the edge of the heater substrate. In this embodiment, the printhead housing 116 is sealed around the outwardly extending portion 170 of the heater substrate 120 using an adhesive, epoxy, or other appropriate sealant. In an alternative embodiment, the printhead housing includes a plurality of electrical contacts which electrically connect with the heater substrate and the associated heater and drive circuitry contained therein. In yet another alternative embodiment, the printhead housing includes means for holding or otherwise supporting a flex cable, which contains electrical contacts for mating with the heater substrate.

Figure 6:
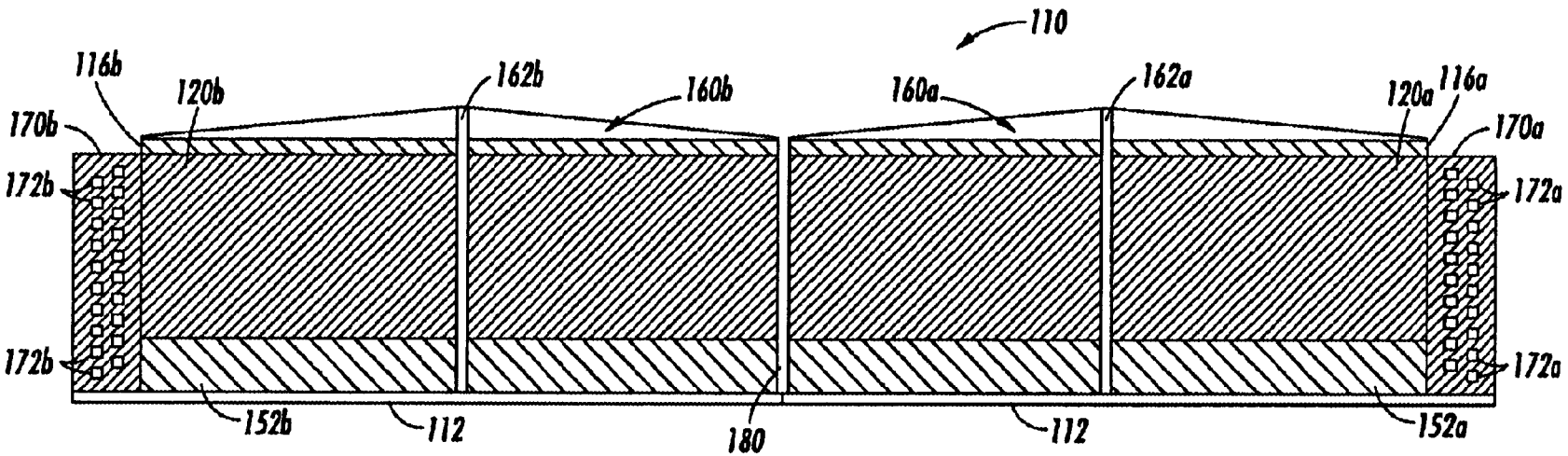
FIG. 6 is a partial cross-sectional side view of an abutted heater substrate printhead having multiple ink cavities in accordance with an alternate embodiment of the present invention.

As shown in FIG. 6, the present invention is applicable to a printhead 110 having two abutted heater substrates 120*a*, 120*b*, each having a protruding portion 170*a*, 170*b* with a plurality of electrical contacts 172*a*, 172*b*. In one embodiment, illustrated in FIG. 7, the two heater substrates 120*a*, 120*b* are included in two corresponding printhead housings 116*a*, 116*b*. In this embodiment, each individual printhead housing 116*a*, 116*b* includes an air trap 160*a*, 160*b* as well as the other features described above with reference to FIGS. 3 and 4. Preferably, both printhead housings are bonded to a single nozzle plate 112 and are adhesively secured together along a mating line 180. In another embodiment, the two heater substrates are included within a single printhead housing, which defines a single ink cavity.

Figure 7:
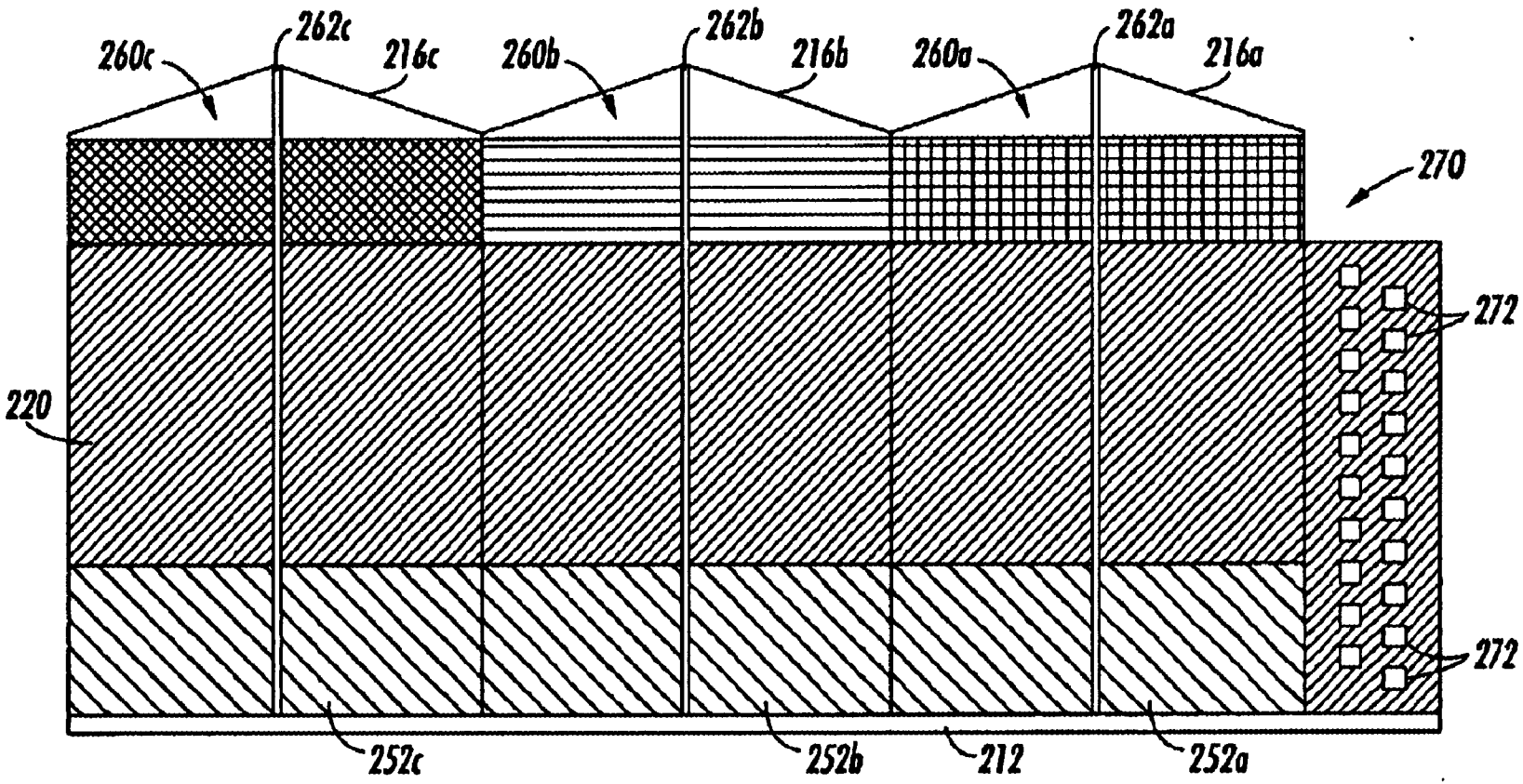
FIG. 7 is a partial cross-sectional side view or a 3-color printhead in accordance with the present invention.
Figure 8:
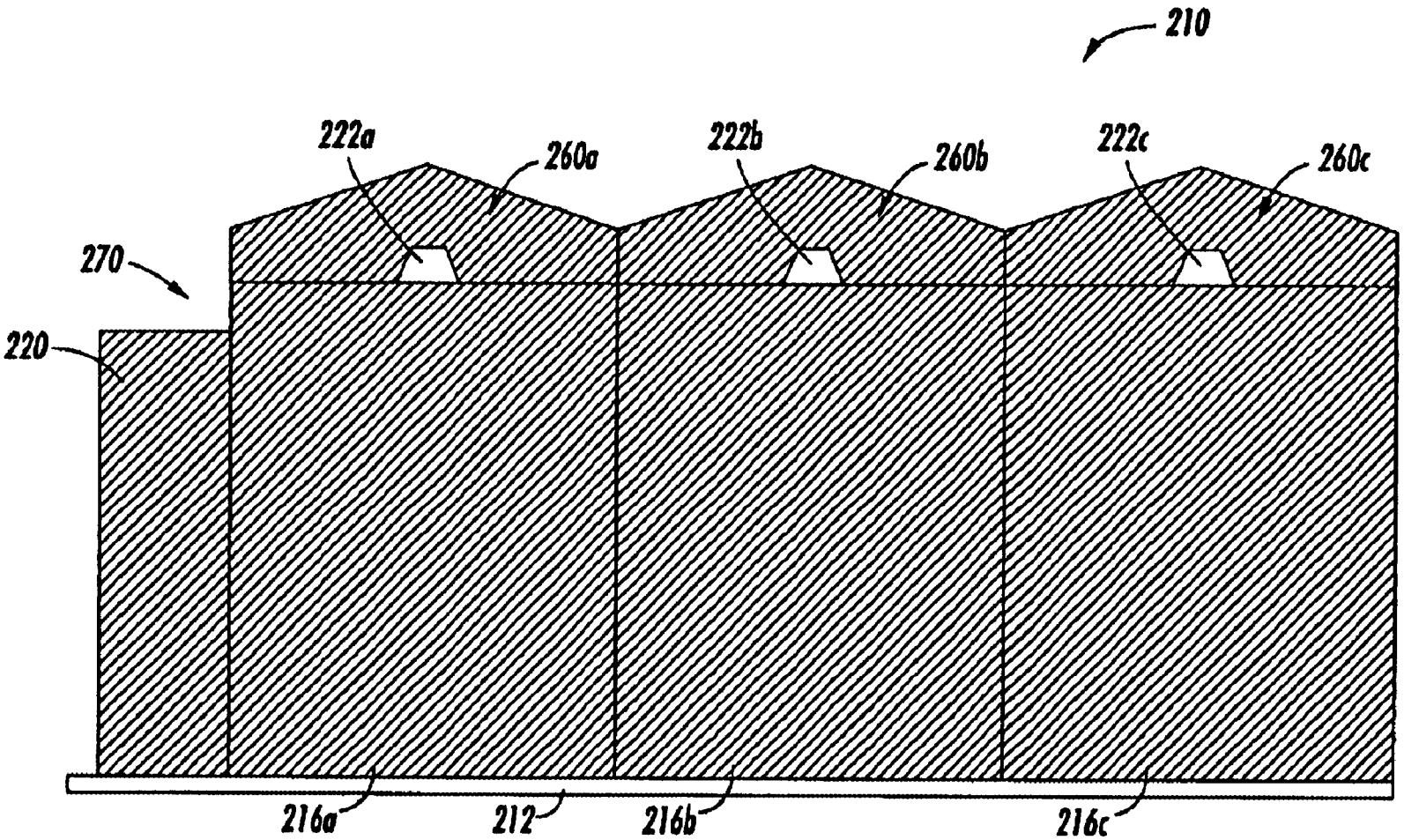
FIG. 8 is an external side view of a 3-color printhead in accordance with the present invention.

FIGS. 7 and 8 show a 3-color printhead 210 in accordance with the present invention. The 3-color printhead 210 includes a single heater substrate 220, which extends through three printhead housings 216*a*, 216*b*, 216*c*. Each of the three printhead housings 216*a*, 216*b*, 216*c* are bonded or otherwise secured to a single nozzle plate 212 and include all of the features described above with reference to FIGS. 3 and 4. Preferably, the individual ink cavities defined by the three print housings 216*a*, 216*b*, 216*c* are sealed using appropriate adhesives as are known to skilled artisans. Each of the printhead housings includes respective air traps 260*a*, 260*b*, 260*c* in communication with three separate air removal means 262*a*, 262*b*, 262*c*. As is described more fully above, a portion 270 of the single heater substrate 220, having a plurality of electrical contacts 272 thereon, extends outside of one of the printhead housings 216*a*, which is sealed around the protruding heater substrate.

Figure 9:
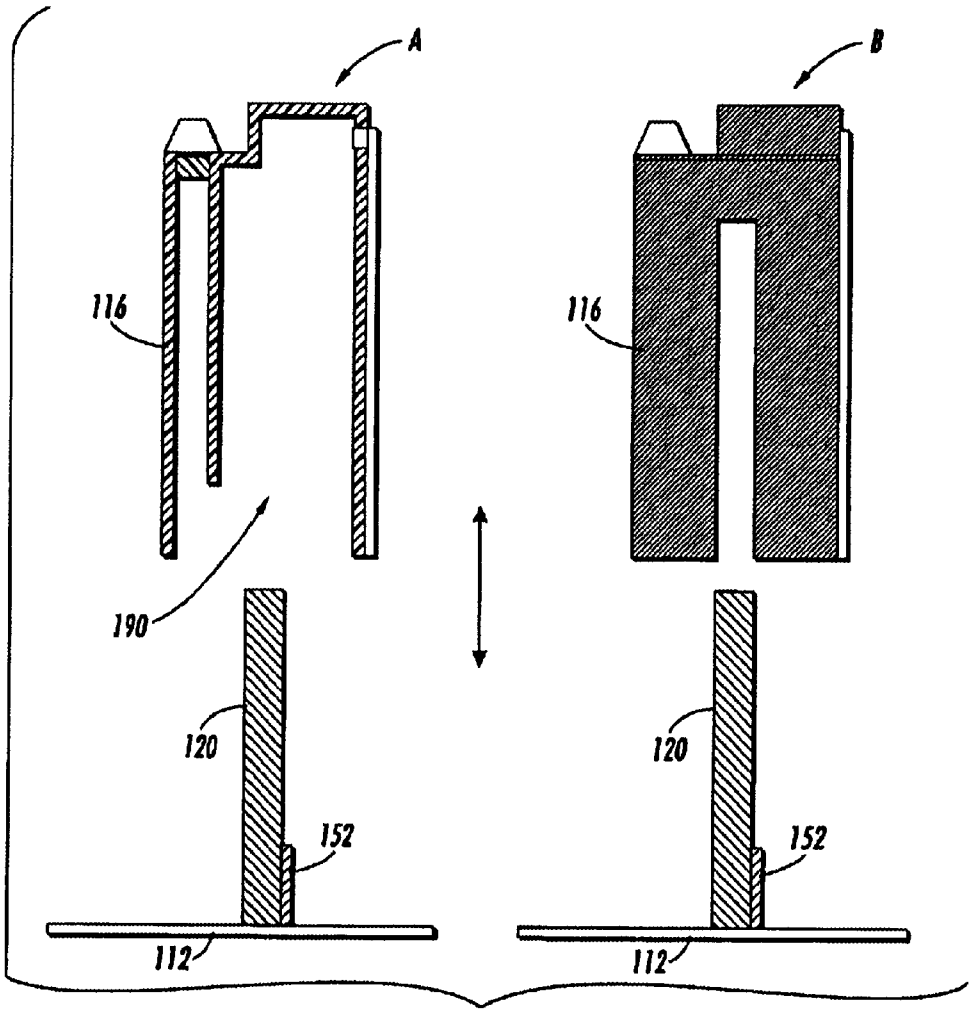
FIG. 9 is a diagrammatic illustration of a method of assembling a printhead in accordance with the present invention; and, FIG. 10 is a diagrammatic illustration of a method of assembling a printhead in accordance with an alternate embodiment of the present invention.

With reference to FIG. 9, one method of assembling the printhead embodying the present invention is illustrated. The leftmost view A shows a cutaway view, while the rightmost view B shows an external view. A heater substrate or die 120 having and integral nozzle or face plate 112 and channel cap plate 152 is inserted into a molded printhead housing 116, which includes the remaining portion of the ink cavity 190. A suitable adhesive is used to seal the printhead housing 116 to the nozzle plate 112 as well as to seal a portion of the printhead housing to the protruding portion of the heater substrate. Alternately, the heater substrate 120 can be inserted into the printhead housing 116 prior to bonding the nozzle plate 112 to the heater substrate 120 and sealing the perimeter of the printhead housing 116 to the nozzle plate 112.

Figure 10:
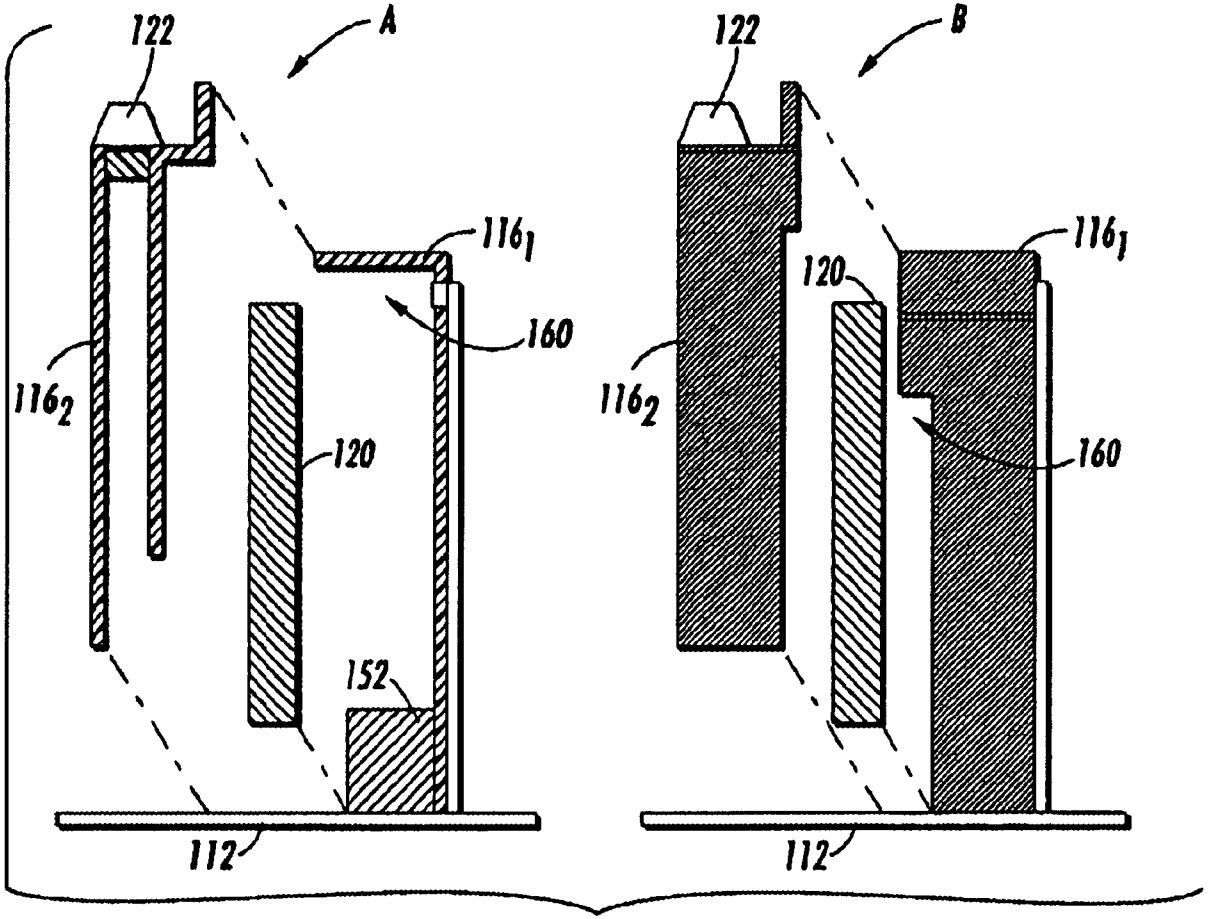

In an alternate embodiment, illustrated in FIGS. 10, where the leftmost view A shows a cutaway view, while the rightmost view B shows an external view, a first portion $\mathbf{116}_1$ of the printhead housing, which includes the air trap 160 is initially joined to or otherwise formed with the nozzle plate 112 and the channel cap plate 152. The heater substrate 120 is then inserted within this first piece, as shown. Finally, a second portion 1162 of the printhead housing, which includes the ink inlet 122, is sealed around the heater substrate 120 and to the nozzle plate 112. It is to be appreciated that such an assembly provides for relatively easy application of any adhesives needed as well as an opportunity to shape the printhead housing for easy molding.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. A device for selectively ejecting droplets of at least one fluid, said device comprising:

a nozzle plate which defines a plurality of fluid-emitting nozzles;

a heater substrate disposed adjacent and substantially perpendicular to the nozzle plate, said heater substrate having a rear surface, a front surface, a top surface, and a bottom surface, wherein the rear and front surfaces are substantially larger than the top and bottom surfaces;

a fluid housing attached to the nozzle plate, said fluid housing including:

a fluid inlet configured to permit a flow of fluid;

a first internal wall which defines a fluid flow path such that fluid flows from the fluid inlet substantially around all of the rear, top and front surfaces of the heater substrate;

an intermediate layer disposed adjacent a portion of the front surface of the heater substrate, said intermediate layer defining a plurality of fluid flow channels in fluid communication with the plurality of nozzles; and a channel cap plate disposed adjacent the intermediate layer, said channel plate capping the plurality of fluid flow channels.

2. The device according to claim 1, wherein the fluid housing includes a fluid filter adjacent the fluid inlet.

3. The device according to claim 1, wherein the intermediate layer comprises a thermally conductive material.

4. The device according to claim 1, wherein the channel cap plate is comprised of a plastic material.

5. The device according to claim 1, wherein the nozzle plate is oriented substantially perpendicular to an associated medium.

6. The device according to claim 5, wherein a portion of the heater substrate extends outward through the fluid housing, said fluid housing being sealably attached to the outwardly extending portion of the heater substrate.

7. The device according to claim 6, wherein the outwardly extending portion of the heater substrate includes a plurality of electrical contacts.

8. The device according to claim 5, wherein the fluid housing includes an air bubble accumulation chamber adjacent a top portion of the fluid housing.

9. The device according to claim 8 further comprising:

means for releasing accumulated air bubbles from the bubble accumulation chamber.

10. A printhead for use with an ink jet printer, said printhead comprising:

a nozzle plate which defines a plurality of ink-emitting nozzles, a heater substrate disposed adjacent and substantially perpendicular to the nozzle plate, a printhead housing attached to the nozzle plate which substantially surrounds the heater substrate, said printhead housing having a first internal wall which defines an ink flow path around the heater substrate; and an ink flow channel defining layer including an intermediate layer disposed adjacent a portion of the heater substrate and a channel cap plate disposed adjacent the intermediate layer, said ink flow channel defining layer defining a plurality of ink flow channels in fluid communication with the plurality of nozzles.

11. The printhead according to claim 10, wherein the printhead housing includes an air bubble accumulation chamber adjacent a top portion of the printhead housing for accumulating air bubbles caused by heating of ink by the heater substrate.

12. The printhead according to claim 11 further comprising:

means for releasing air bubbles accumulated within the air bubble accumulation chamber.

13. The printhead according to claim 11, wherein the first internal wall extends along a direction parallel to the heater substrate, such that the ink flow path begins at a bottom, rear surface of the heater substrate and extends around top and front surfaces of the heater substrate.

14. The printhead according to claim 13, wherein the intermediate layer comprises a thermally conductive material.

15. The printhead according to claim 14, wherein the channel cap plate comprises a plastic material.

16. The printhead according to claim 15, wherein the printhead housing includes an ink filter disposed along the ink flow path before the bottom, rear surface of the heater substrate.

17. The printhead according to claim 11, wherein a portion of the heater substrate extends through at least one external wall of the printhead housing, said printhead housing being sealed around the outwardly extending portion of the heater substrate.

18. The device according to claim 17, wherein the outwardly extending portion of the heater substrate includes a plurality of electrical contacts.

* * * * *